US008011947B2

(12) United States Patent
Lai et al.

(10) Patent No.: US 8,011,947 B2
(45) Date of Patent: Sep. 6, 2011

(54) HDMI ASSEMBLY AND HDMI PORT FOR THE SAME

(75) Inventors: Chih-Ming Lai, Taipei Hsien (TW); Yung-Shun Kao, Taipei Hsien (TW)

(73) Assignee: Giga-Byte Technology Co., Ltd., Taipei (TW)

( * ) Notice: Subject to any disclaimer, the term of this patent is extended or adjusted under 35 U.S.C. 154(b) by 113 days.

(21) Appl. No.: 12/539,999

(22) Filed: Aug. 12, 2009

(65) Prior Publication Data

US 2011/0039438 A1 Feb. 17, 2011

(51) Int. Cl.
*H01R 13/627* (2006.01)

(52) U.S. Cl. ..... 439/358; 439/660; 439/607.41

(58) Field of Classification Search ..... 439/358, 439/660, 607.41, 607.53
See application file for complete search history.

(56) References Cited

U.S. PATENT DOCUMENTS

| | | | | |
|---|---|---|---|---|
| 6,848,932 | B2 * | 2/2005 | Bowling et al. | 439/358 |
| 6,890,205 | B1 * | 5/2005 | Wu | 439/358 |
| 6,902,432 | B2 * | 6/2005 | Morikawa et al. | 439/607.41 |
| 7,128,595 | B2 * | 10/2006 | Boutros | 439/358 |
| 7,182,622 | B2 * | 2/2007 | Chang | 439/352 |
| 7,581,978 | B1 * | 9/2009 | Briant | 439/358 |

* cited by examiner

*Primary Examiner* — Hien Vu
(74) *Attorney, Agent, or Firm* — Chun-Ming Shih

(57) ABSTRACT

A high definition multimedia interface (HDMI) assembly for providing an electrical connection between two electronic devices includes an HDMI port and an HDMI plug. The HDMI port includes a first connection element and a pin portion. The HDMI plug includes a second connection element. The first connection element is pivotably disposed on the HDMI port and includes a hook, and the pin portion is connected to the HDMI port for providing connection between the HDMI port and one of the electronic devices. When the HDMI plug is connected to the HDMI port, the second connection element and the first connection element contact with each other and the hook hooks the HDMI plug.

15 Claims, 5 Drawing Sheets

HDMI ASSEMBLY AND HDMI PORT FOR THE SAME

BACKGROUND

1. Field of the Invention

The present invention relates to a connection assembly and a port for the connection assembly, and more particularly, to a connection assembly of high definition multimedia interface (HDMI) and a port for the HDMI connection assembly.

2. Description of the Related Art

HDMI was first developed by Hitachi, Panasonic, Sony, Thomson (RCA), Toshiba, Philips and Silicon Image in April 2002 with the goal of creating an A/V interface that supports both video and audio for consumer electronics products. At the time, digital visual interface (DVI) developed for personal computer (PC) monitors was being used for transmitting video signals but not for digital audio transmission.

Possessing a bandwidth as high as up to 5 Gbps, HDMI can provide lossless digital video/audio transmission. Different than the conventional separated transmission of audio and video, HDMI combines audio and video transmission over a single cable. HDMI transmits uncompressed digital data, which can effectively reduce signal interference and signal attenuation during the digital-to-analog conversion. In addition to video data, HDMI supports up to 8 channels of digital audio. Therefore, HDMI is expected to be an indispensable multimedia interface used in future digital products. Since the high definition TV only requires 2.2 Gbps of bandwidth, HDMI leaves a plenty of room for video of higher specification in the future.

Now American, European and Japanese vendors have adopted HDMI for their new generation of digital systems such as digital TVs, DVD players, DVD players/recorders, set-top boxes and other digital AV products. Because of the advantages of uncompressed digital AV quality, less number of cables, smaller connector profile and more human interface, HDMI is expected to completely substitute for traditional video terminals (S-video, Component video connector, RGB terminal or the like) in the high-end market and become a representation of high quality digital video.

Conventional HDMI assembly and its HDMI port failed to incorporate a structure for stably retaining an HDMI plug. As a result, after an HDMI plug is plugged into the HDMI port, the HDMI plug can easily become disengaged from the HDMI port which causes a poor signal transmission.

BRIEF SUMMARY

The present invention relates to an HDMI assembly for providing an electrical connection between two electronic devices. The HDMI assembly includes an HDMI port and an HDMI plug. The HDMI port includes a first connection element and a pin portion. The HDMI plug includes a second connection element. The first connection element is pivotably disposed on the HDMI port and includes a hook, and the pin portion is connected to the HDMI port for providing connection between the HDMI port and one of the electronic devices. When the HDMI plug is connected to the HDMI port, the second connection element and the first connection element contact with each other and the hook hooks the HDMI plug.

In one aspect, the HDMI port further has an opening for receiving the HDMI plug.

In another aspect, the first connection element further comprises at least one positioning pin, and the HDMI port further comprises at least one constraining portion to secure the positioning pin.

In another aspect, the HDMI port further comprises a pivot axle pivotably connected to the HDMI port, and the first connection element is pivotable with respect to the HDMI port about the pivot axle.

In another aspect, the first connection element further comprises a recessed portion and the pivot axle is received in the recessed portion.

In another aspect, the first connection element further comprises a pressing portion and a connection portion, upon the pressing portion being depressed, the first connection element pivots about the pivot axle, and the connection portion and the positioning pin form a bend of an obtuse angle.

In another aspect, the HDMI port further comprises a first surface and a second surface, and the first surface and the second surface are opposite to each other.

In another aspect, the first connection element is disposed on the first surface, the pin portion extends from the second surface, and the second surface is configured to contact with one of the electronic devices.

In another aspect, a through hole is defined through the first surface and the hook of the first connection element extends through the through hole.

In another aspect, the second connection element has a slot, and the hook is engaged into the slot to hook the HDMI plug.

In another aspect, the HDMI port further comprises a snap-fit portion in the form of a barb to secure the HDMI port to one of the electronic devices.

In another aspect, the HDMI port further comprises a first member and a second member, the first connection element is disposed on the first member, and the pin portion is disposed on the second member.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
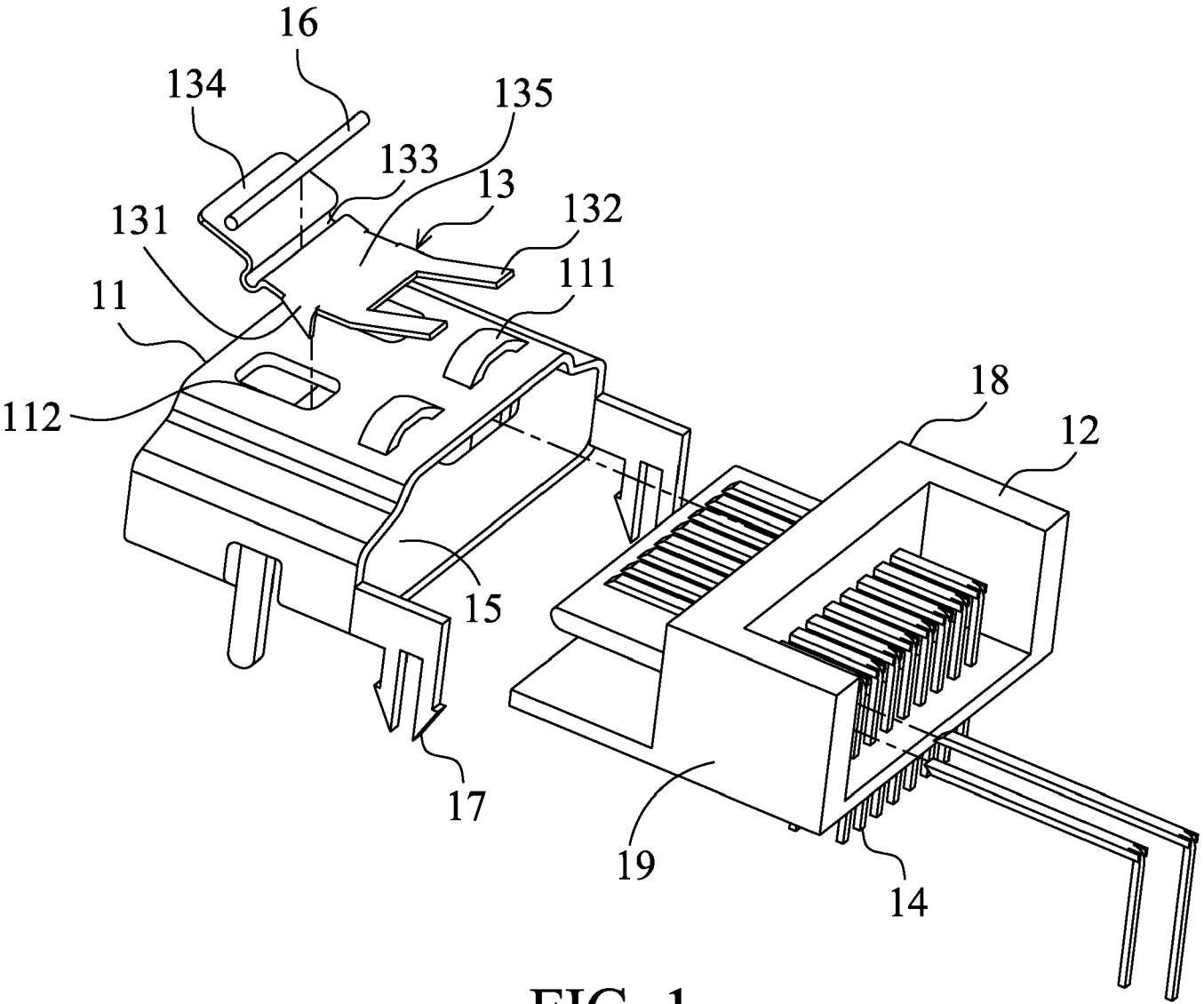
FIG. 1 illustrates an exploded view of an HDMI port according to one embodiment of the present invention.
Figure 2:
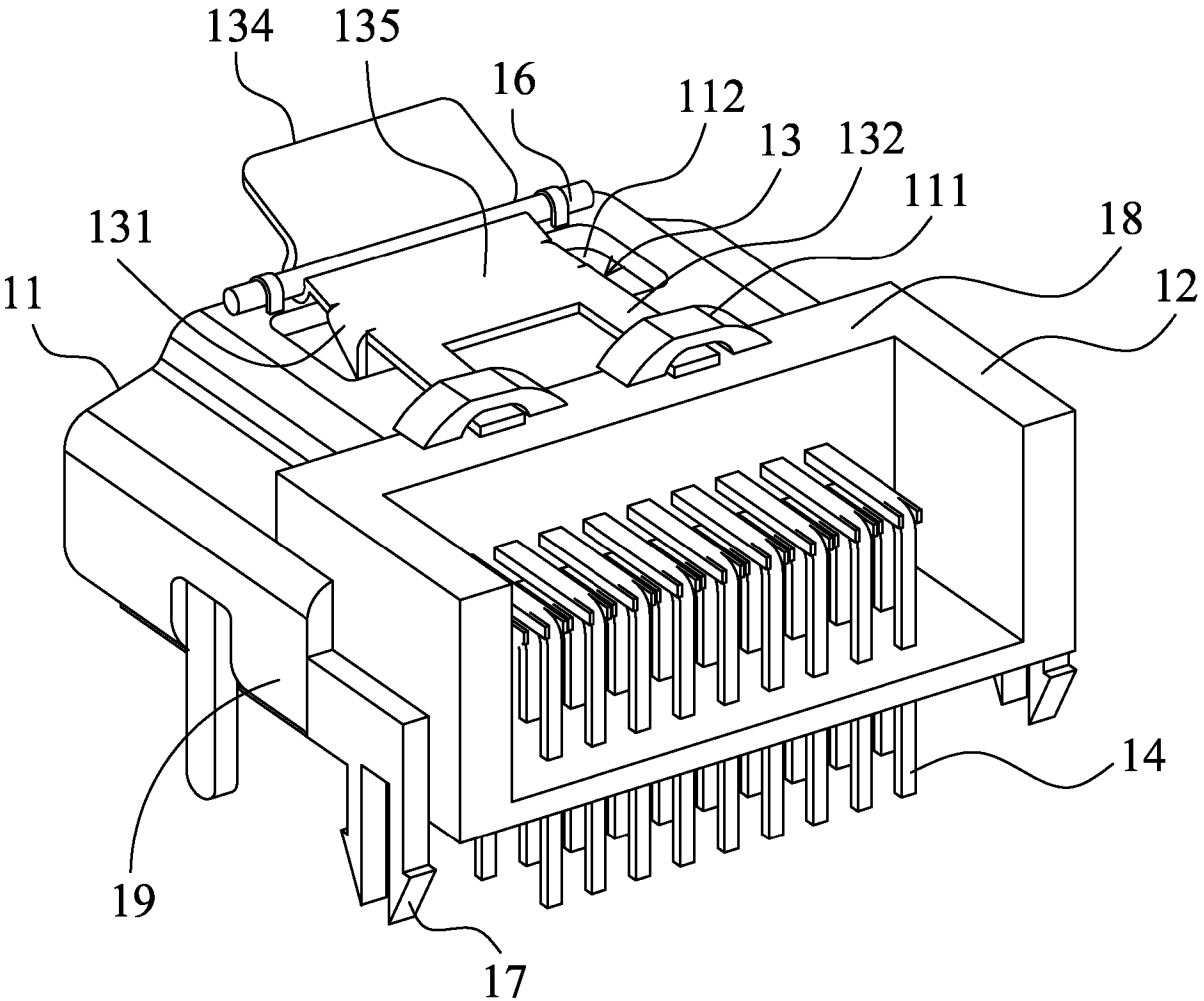
FIG. 2 illustrates an assembled view of the HDMI port.

FIG. 1 illustrates an exploded view of an HDMI port according to one embodiment of the present invention and FIG. 2 illustrates an assembled view of the HDMI port of FIG. 1.

Figure 5:
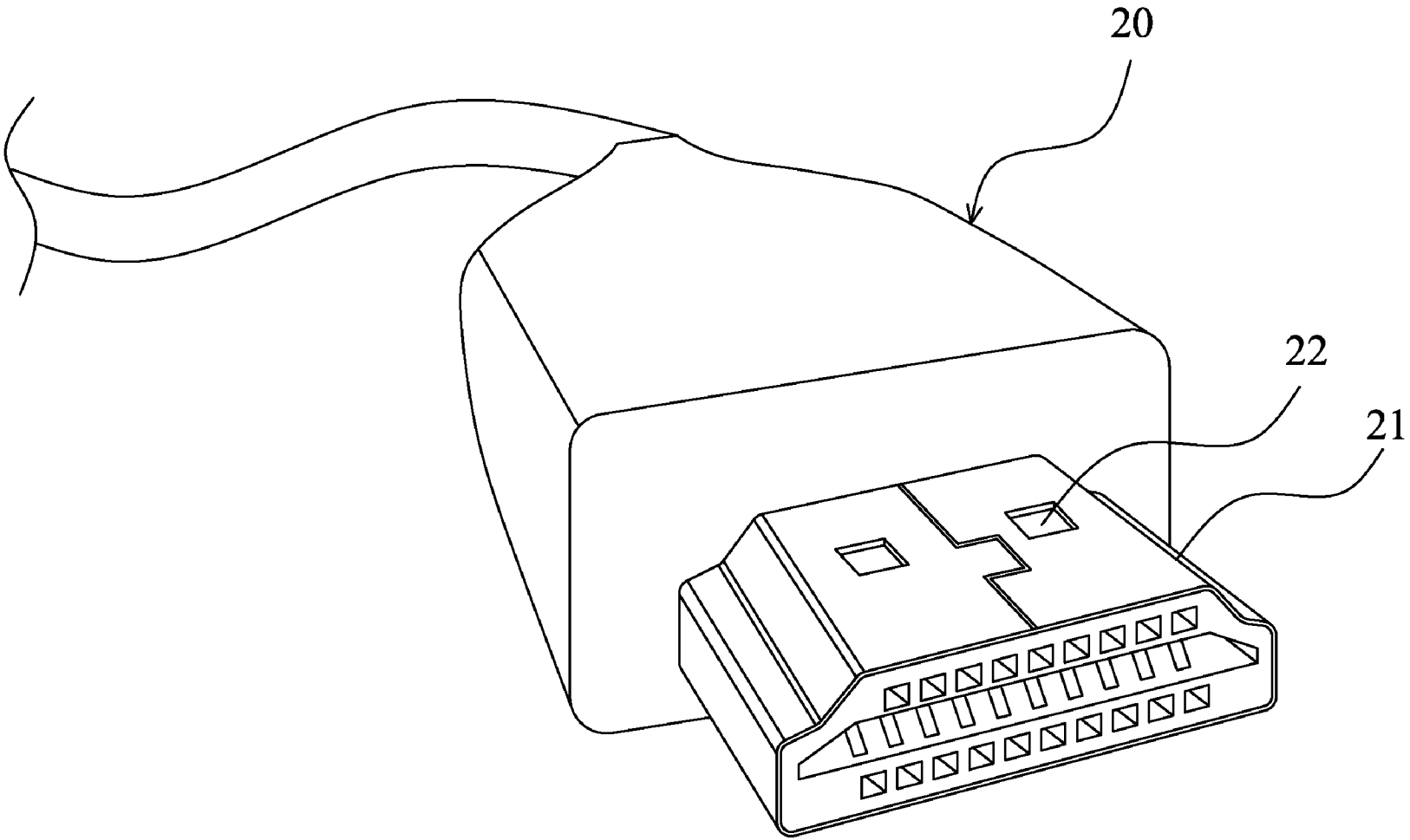
FIG. 5 illustrates an HDMI plug.

Referring to FIG. 1 and FIG. 2, the present HDMI port 10 is configured to be electrically connected with an HDMI plug 20 (shown in FIG. 5). The HDMI port 10 includes a first member 11, a second member 12, a first connection element 13, a pin portion 14, an opening 15, a pivot axle 16, and snap-fit portions 17. The first member 11 is connected to the second member 12. The first connection element 13 is pivotably connected to the first member 11 of the HDMI port 10. The pin portion 14 is disposed on the second member 12. The first member 11 further includes constraining portions 111.

The first connection element 13 includes hooks 131, positioning pins 132, a recessed portion 133, a pressing portion 134, and a connection portion 135. In the present embodiment, the hooks 131 are disposed on opposite sides of the connection portion 135. When the HDMI plug 20 is connected to the HDMI port 10, the hooks 131 can hook the HDMI plug 20 so as to retain the HDMI plug 20. The first connection element 13 can be made of a flexible material.

The positioning pins 132 extend from one end of the connection portion 135 and are locked to the constraining portions 111 of the first member 11. In the present embodiment, the constraining portions 111 are arc-shaped. Once the positioning pins 132 are inserted into the constraining portions 111 to secure one end of the first connection element 13 to the first member 11, the first connection element 13 is pivotable with respect to the first member 11 about the pivot axle 16.

The recessed portion 133 is positioned between the pressing portion 134 and the connection portion 135 for receiving the pivot axle 16. The pivot axle 16 is required to be pivotably connected to the first member 11. The pressing portion 134 is formed at one end of the first connection element 13. When a user depresses the pressing portion 134, the disengagement limit for preventing disengagement between the HDMI port 10 and the HDMI plug 20 can be removed.

The pin portion 14 is formed on the second member 12 to provide an electrical connection between the HDMI port 10 and an electronic device (not shown). The HDMI port 10 is usually electrically connected to a circuit board of the electronic device. In the present embodiment, the opening 15 and the snap-fit portions 17 are formed on the first member 11 and the HDMI plug 20 (referring to FIG. 5) can extend into the opening 15 to be electrically connected to the HDMI port 10. In the present embodiment, the snap-fit portions 17 are in the form of a clamp with end barbs which can provide stable connection between the HDMI port 10 and the circuit board (not shown) of the electronic device.

In addition, the HDMI port 10 has a first surface 18 and a second surface 19. As shown in FIG. 2, the first surface 18 is the upper surface of the HDMI port 10 and the second surface 19 is the lower surface of the HDMI port 10, such that the first surface 18 and the second surface 19 are opposite to each other. The first connection element 13 is disposed on the first surface 18, while the pin portion 14 extends downward from the second surface 19. That is, the first connection element 13 and the pin portion 14 are disposed on opposite surfaces. The second surface 19 is used to contact with one electronic device. The locations of first connection portion 13 and the pin portion 14 may also be varied if the layout of the circuit board of the electronic device is changed.

Figure 3:
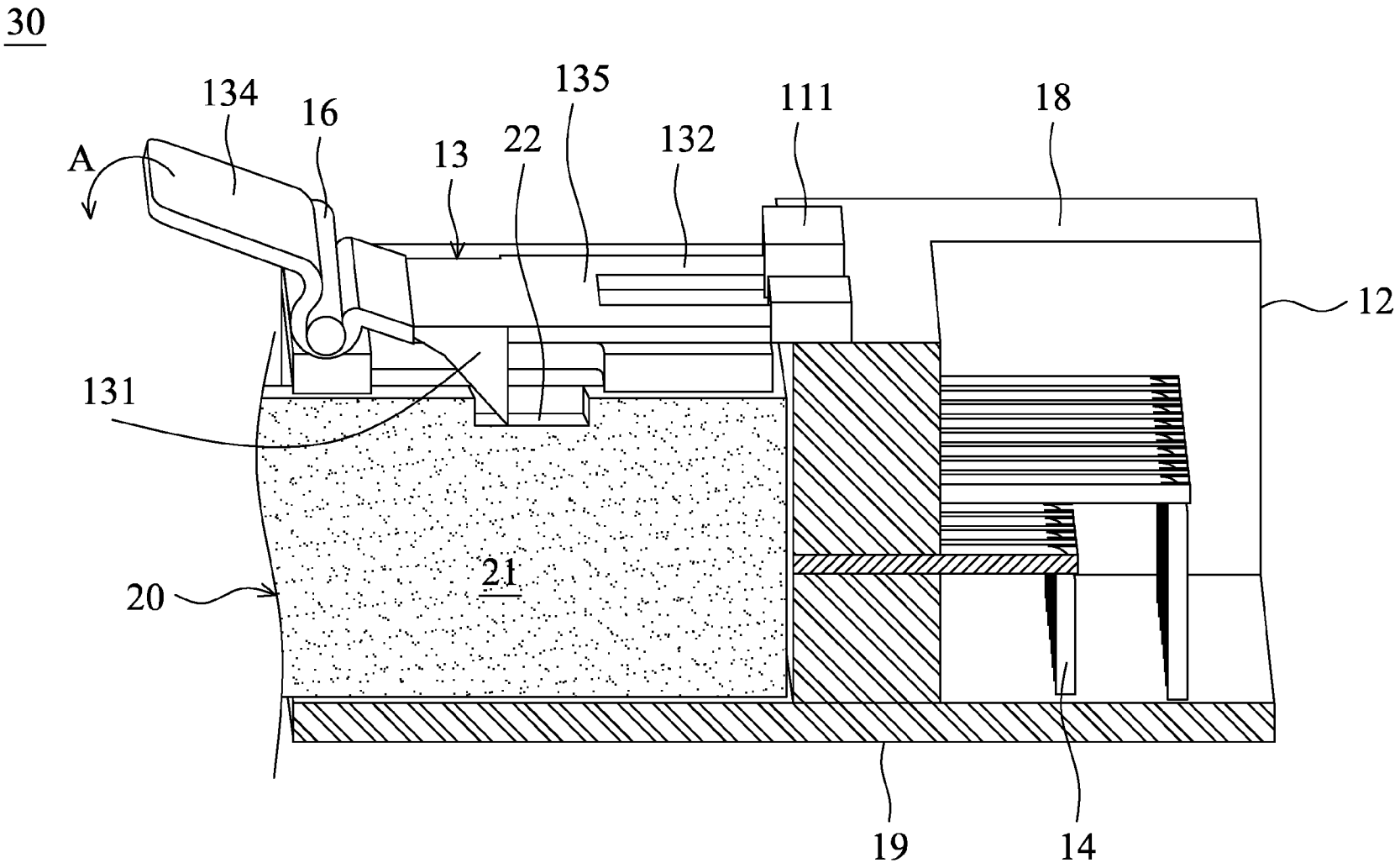
FIG. 3 illustrates an engaging state of an HDMI assembly.
Figure 4:
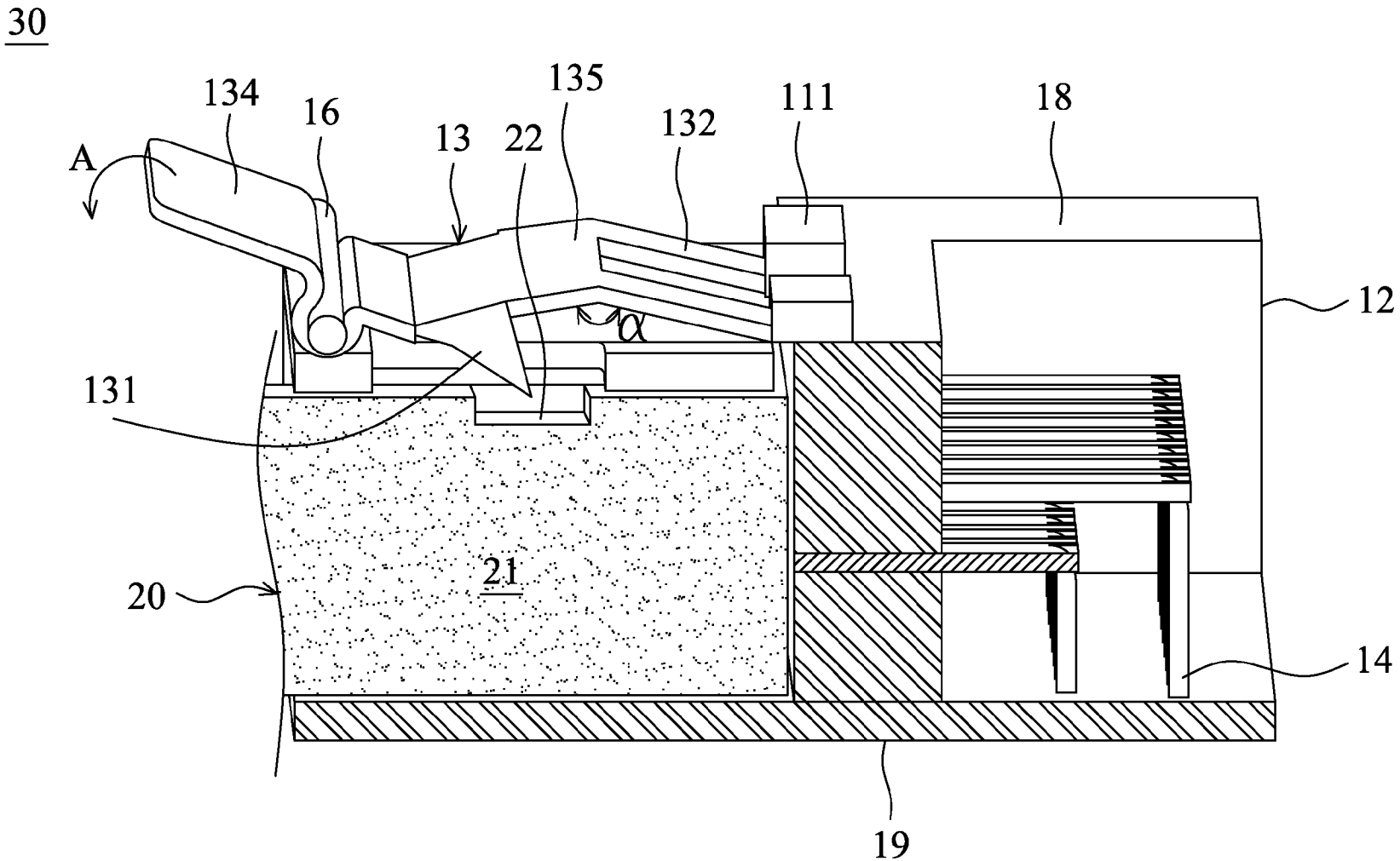
FIG. 4 illustrates a disengaging operation of the HDMI assembly.

FIG. 3 illustrates an assembled view of the HDMI assembly. FIG. 4 illustrates a disengaging operation of the HDMI assembly. FIG. 5 illustrates the HDMI plug.

Referring to FIGS. 3 to 5, the HDMI assembly 30 includes the HDMI plug 20 and the HDMI port 10. The HDMI assembly 30 can be used as a connecting interface for two electronic devices. The HDMI plug 20 includes a second connection element 21 with slots 22 defined therein. Through holes 112 are defined through the first surface 18 at the first member 11. The hooks 131 can extend downward to pass the through holes 112 and can thus be engaged into the through holes 112.

When the HDMI plug 20 is connected to the HDMI port 10, the hooks 131 of the first connection element 13 are engaged with the second connection element 21 to hook the HDMI plug 20. As shown in FIG. 3, the hooks 131 are engaged with the second connection element 21 at the slots 22 such that the HDMI plug 20 is locked in the horizontal direction. As a result, the HDMI 20 cannot easily become disengaged from the HDMI port 10.

When it is desired to remove the HDMI plug 20 from the HDMI port 10, the pressing portion 134 can be depressed in the direction indicated by arrow A. At this time, the first connection element 13 pivots about the pivot axle 16. However, since the positioning pins 132 of the first connection element 13 are constrained by the constraining elements 111 and the first connection element 13 is flexible, upon the pressing portion 134 being depressed, a bend is formed between the connection portion 135 and the positioning pins 132, i.e., the connection portion 135 and the positioning pins 132 that are coplanar in FIG. 3 form a bend of an obtuse angle $\alpha$ shown in FIG. 4, and simultaneously the hooks 131 are disengaged from the second connection element 21. At this time, the user can readily pull the HDMI plug 20 out of the HDMI port 10.

In view of the foregoing, with the present configuration of the HDMI assembly 30, the HDMI plug 20 can be more stably connected to the HDMI port 10, thereby avoiding a signal interruption during the signal transmission.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A high definition multimedia interface (HDMI) assembly for providing an electrical connection between two electronic devices, comprising:

an HDMI port including a first member having a first connection element and a second member having a pin portion; and an HDMI plug including a second connection element; wherein the first connection element is pivotably disposed on the HDMI port and includes a hook, and the pin portion is connected to the HDMI port for providing the connection between the HDMI port and the plug;

wherein the first connection element further comprises at least one positioning pin, and the first member further comprises at least one constraining portion to secure the positioning pin;

wherein the first connection element further comprises a pivot axle pivotably connected to the first member, and the first connection element is pivotable with respect to the HDMI port about the pivot axle;

wherein the first connection element further comprises a pressing portion and a connection portion, upon the pressing portion being depressed, the first connection element pivots about the pivot axle, and the connection portion and the positioning pin form a bend of an obtuse angle;

wherein the second connection element and the first connection element contact with each other and the hook hooks the HDMI plug when the HDMI plug is connected to the HDMI port; and wherein the first connection element further comprises a recessed portion and the pivot axle is received in the recessed portion.

2. The module according to claim 1, wherein the HDMI port further has an opening for receiving the HDMI plug.

3. The module according to claim 1, wherein the HDMI port further comprises a first surface and a second surface, and the first surface and the second surface are opposite to each other.

4. The module according to claim 3, wherein the first connection element is disposed on the first surface, the pin portion extends from the second surface.

5. The module according to claim 4, wherein a through hole is defined through the first surface and the hook of the first connection element extends through the through hole.

6. The module according to claim 1, wherein the second connection element has a slot, and the hook is engaged into the slot to hook the HDMI plug.

7. The module according to claim 1, wherein the HDMI port further comprises a snap-fit portion in the form of a barb.

8. The module according to claim 1, wherein the HDMI port further comprises a first member and a second member, the first connection element is disposed on the first member, and the pin portion is disposed on the second member.

9. A high definition multimedia interface (HDMI) port configured for electrical connection with an HDMI plug so as to electrically connect two electronic devices, the HDMI plug including a second connection element, the HDMI port comprising:

a first member having a first connection element pivotally disposed on the HDMI port and comprising a hook;

wherein the first connection element further comprises at least one positioning pin, and the HDMI port further comprises at least one constraining portion to secure the positioning pin;

a second member having a pin portion connected to the HDMI port for providing connection between the HDMI port and the plug;

wherein the second connection element and the first connection element contact with each other and the hook hooks the HDMI plug when the HDMI plug is connected to the HDMI port; and a pivot axle pivotably connected to the first member, wherein the first connection element is pivotable with respect to the HDMI port about the pivot axle;

wherein the first connection element further comprises a pressing portion and a connection portion, upon the pressing portion being depressed, the first connection element pivots about the pivot axle, and the connection portion and the positioning pin form a bend of an obtuse angle; and wherein the first connection element further comprises a recessed portion and the pivot axle is received in the recessed portion.

10. The port according to claim 9, further having an opening for receiving the HDMI plug.

11. The port according to claim 9, further comprising a first surface and a second surface, the first surface and the second surface being opposite to each other.

12. The module according to claim 11, wherein the first connection element is disposed on the first surface, the pin portion extends from the second surface.

13. The port according to claim 12, wherein a through hole is defined through the first surface and the hook of the first connection element extends through the through hole.

14. The module according to claim 9, wherein the HDMI port further comprises a snap-fit portion in the form of a barb.

15. The module according to claim 9, further comprising a first member and a second member, wherein the first connection element is disposed on the first member and the pin portion is disposed on the second member.

* * * * *